US006441563B1

(12) United States Patent
Kao et al.

(10) Patent No.: US 6,441,563 B1
(45) Date of Patent: Aug. 27, 2002

(54) DYNAMIC COLOR TEMPERATURE AND COLOR DEVIATION CALIBRATION METHOD

(75) Inventors: Shiuh-Bin Kao; Yi-Sheng Yu; Kuang-Lang Chen; Ching-Hui Lin, all of Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 09/859,398

(22) Filed: May 18, 2001

(30) Foreign Application Priority Data

Apr. 3, 2001 (TW) ..... 090108028

(51) Int. Cl.[7] ..... G09G 3/10

(52) U.S. Cl. ..... 315/169.3; 315/169.4; 348/674

(58) Field of Search ..... 315/169.3, 169.4, 315/169.1; 345/214, 76, 77; 348/180, 655, 671, 674, 675, 687

(56) References Cited

U.S. PATENT DOCUMENTS 6,018,361 A * 1/2000 Fujii et al. ..... 348/180

6,184,849 B1 * 2/2001 Stoller ..... 315/169.4

* cited by examiner

*Primary Examiner*—Tho Phan
*Assistant Examiner*—Thuy Vinh Tran
(74) *Attorney, Agent, or Firm*—Bacon & Thomas, PLLC

(57) ABSTRACT

A dynamic color temperature and color deviation calibration method is provided for eliminating problems associated with color temperature change and color deviation caused by an emissivity change of red, green and blue phosphor layers of a plasma display panel (PDP). The method comprises the steps of utilizing laws of color matching for calculating an emissivity change of a pixel of the PDP in response to a brightness change of one of red, green, and blue lights emitted by a corresponding one of red, green and blue discharge cells of the PDP through a numeric operation; dynamically adjusting brightness of one of the emitted red, green, and blue lights by increasing or decreasing strength of input video signal of each of the discharge cells; and eliminating a color temperature and a color deviation of the PDP due to an emissivity change. This can render an image having an optimum color purity and color temperature by eliminating adverse effects on PDP due to emissivity change.

8 Claims, 5 Drawing Sheets

DYNAMIC COLOR TEMPERATURE AND COLOR DEVIATION CALIBRATION METHOD

FIELD OF THE INVENTION

The present invention relates to plasma display panels (PDPs) and more particularly to a dynamic color temperature and color deviation calibration method for improving image quality shown on PDP.

BACKGROUND OF THE INVENTION

A manufacturing process of a conventional alternating current discharge type plasma display panel (PDP) 10 is shown in FIG. 1. First, two different activation layers are formed on glass substrates 11 and 12 respectively. Then seal the peripheries of the glass substrates together. A mixed gas consisting of helium (He), neon (Ne), and xenon (Xe) (or argon (Ar)) having a predetermined mixing volume ratio is stored in a discharge space formed in between the glass substrates. A front plate 11 is defined as one that facing viewers. A plurality of parallel spaced transparent electrodes 111, a plurality of parallel spaced bus electrodes 112, a dielectric layer 113, and a protective layer 114 are formed from the front plate 11 inwardly. From a corresponding rear plate 12 inwardly, a plurality of parallel spaced data electrodes 121, a dielectric layer 124, a plurality of parallel spaced ribs 122, and a uniform phosphor layer 123 are formed. When a voltage is applied on electrodes 111, 112, and 121, dielectric layers 113 and 124 will discharge in discharge cell 13 formed by adjacent spaced ribs 122. As a result, a ray having a desired color is emitted from phosphor layer 123.

The emissivity of a phosphor layer 123 is varied as panel temperature or operating frequency of PDP changes. Accordingly, as referring to FIGS. 2, 3 and 4 color temperature change and color deviation are occurred on panel of PDP 10, resulting in a poor image quality shown on panel. Above operating frequency is defined as discharge number per unit time occurred on a discharge cell 13. The higher the discharge number the higher the operating frequency will be. As shown in FIG. 2, the higher the operating frequency the lower the emissivity of phosphor layer 123 will be. This condition is even worse in a green phosphor layer 123. Hence, undesired color temperature change and color deviation are occurred on the conventional PDP as panel temperature and operating frequency increase. This in turn renders an unacceptable image quality.

SUMMARY OF THE INVENTION

It is thus an object of the present invention to provide a dynamic calibration method implemented on a plasma display panel (PDP), the method comprising the steps of: (a) utilizing laws of color matching for calculating an emissivity change of a pixel of the PDP in response to a brightness change of one of red, green, and blue lights emitted by a corresponding one of red, green and blue discharge cells of the PDP through a numeric operation; (b) dynamically adjusting brightness of one of the emitted red, green, and blue lights by increasing or decreasing strength of input video signal of each of the discharge cells; and (c) eliminating a color temperature and a color deviation of the PDP due to an emissivity change. The invention can render an image having an optimum color purity and color temperature by eliminating adverse effects on PDP due to emissivity change.

The above and other objects, features and advantages of the present invention will become apparent from the following detailed description taken with the accompanying drawings.

DETAILED DESCRIPTION OF THE PREFERRED EMBODIMENTS

Figure 1:
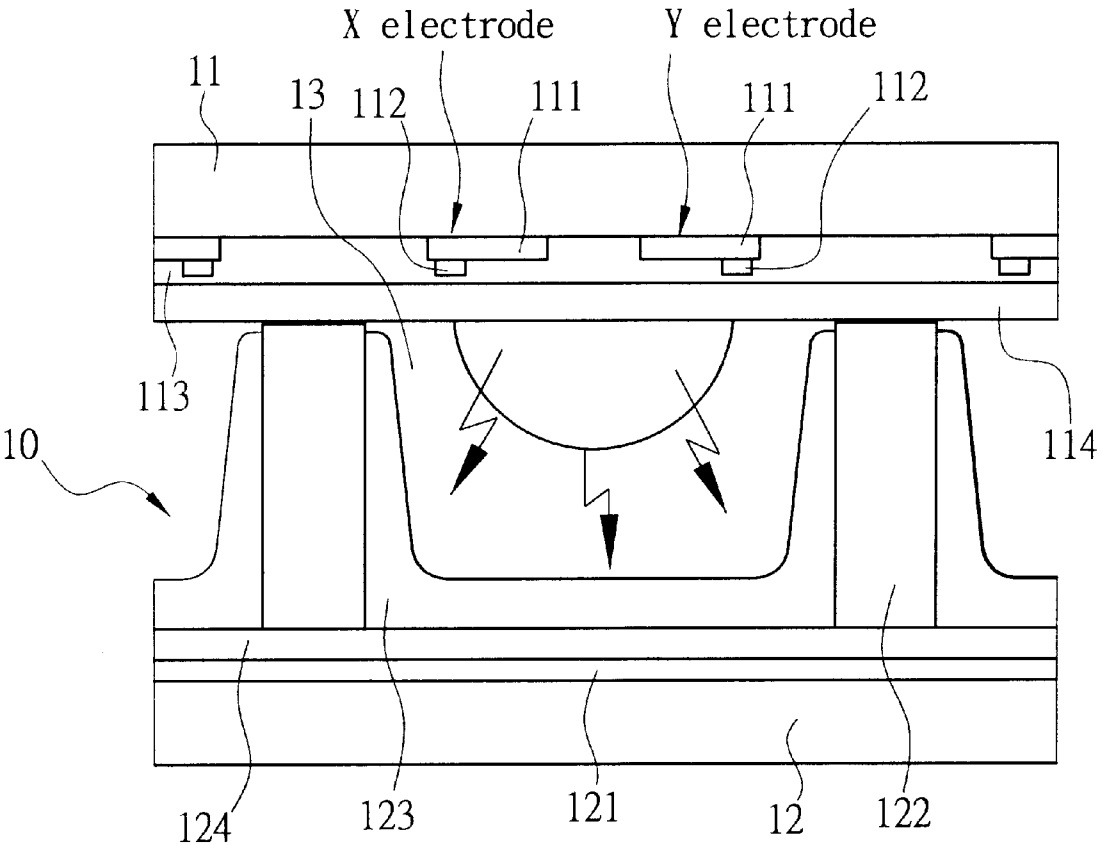
FIG. 1 (Prior Art)
FIG. 1 is a sectional view of a conventional plasma display panel (PDP)
Figure 2:
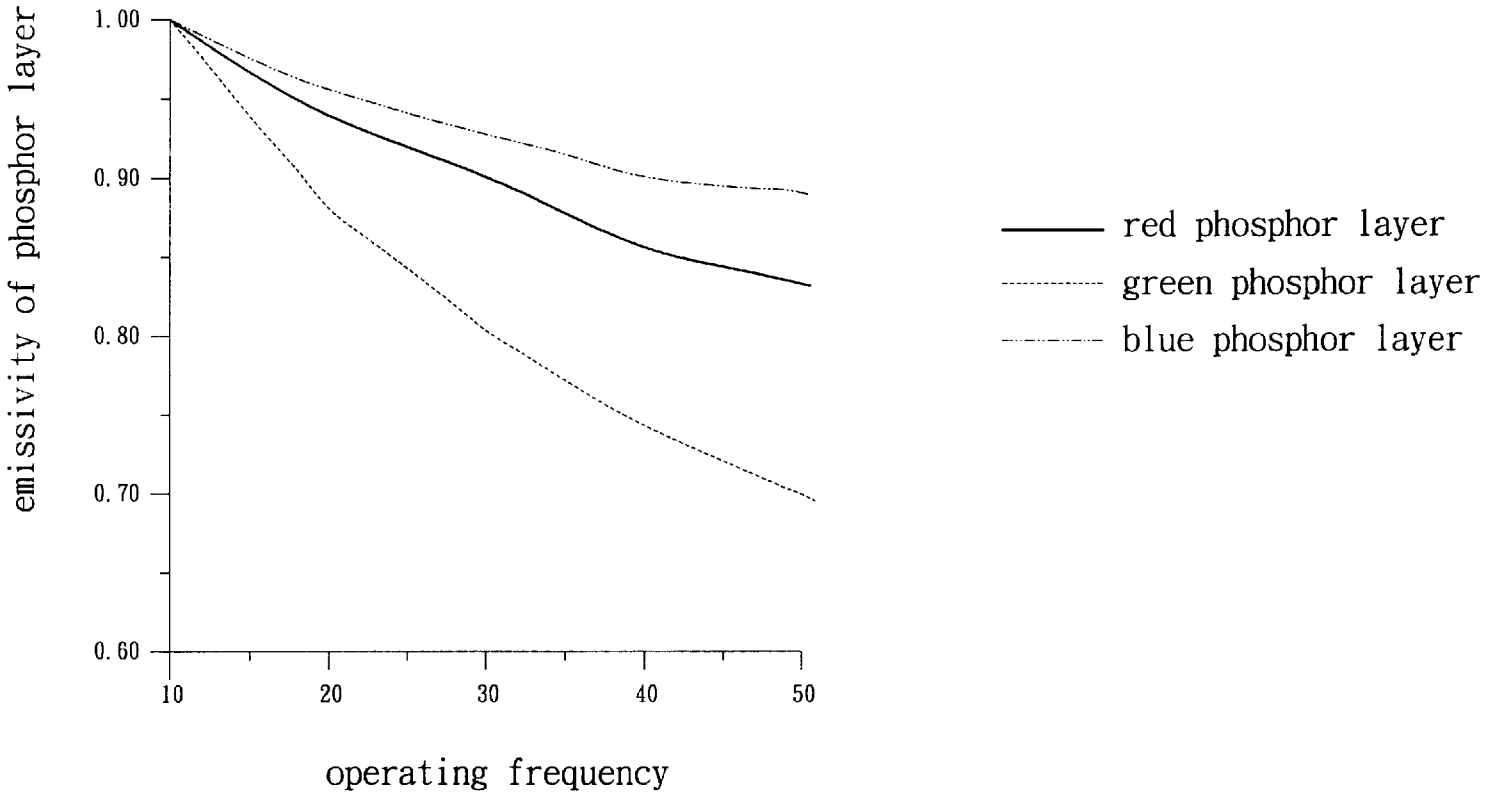
FIG. 2 (Prior Art)
FIG. 2 is a graph showing a relationship of emissivity of various phosphor layers versus operating frequency measured in the FIG. 1 PDP.
Figure 3:
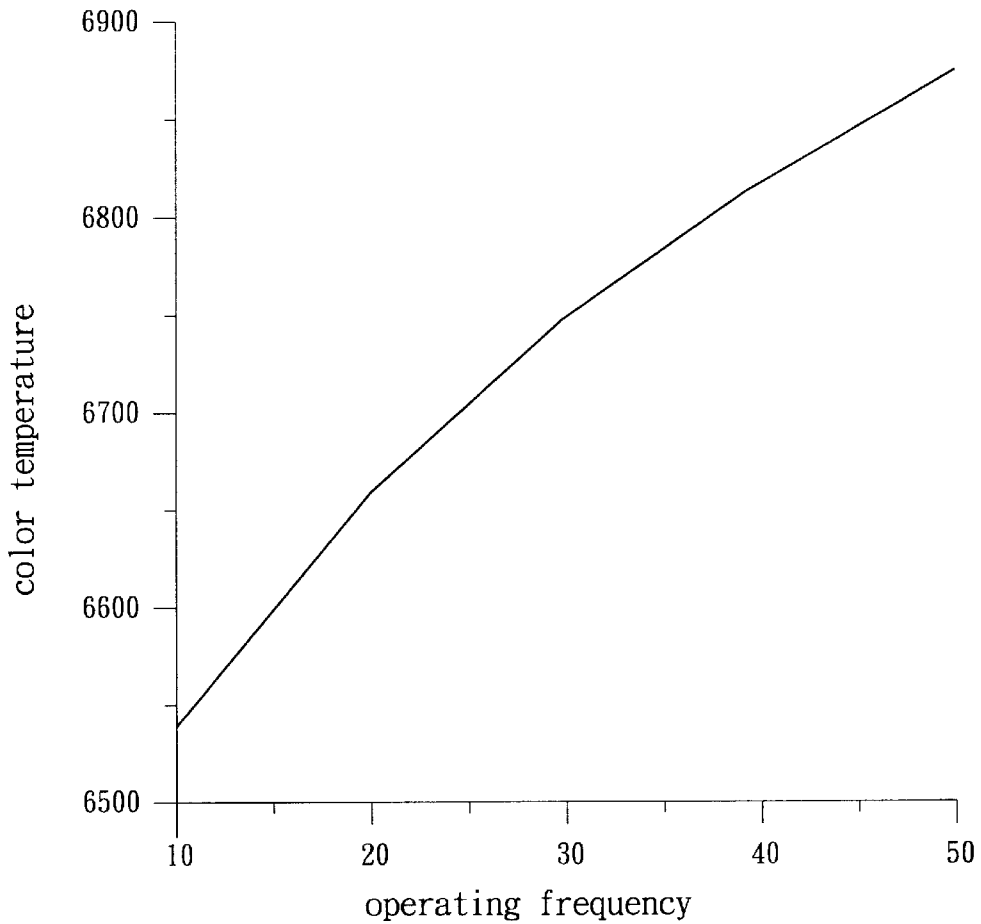
FIG. 3 (Prior Art)
FIG. 3 is a graph showing a relationship of color temperature versus operating frequency of a preferred embodiment of dynamic color temperature and color deviation calibration method according to the invention.
Figure 4:
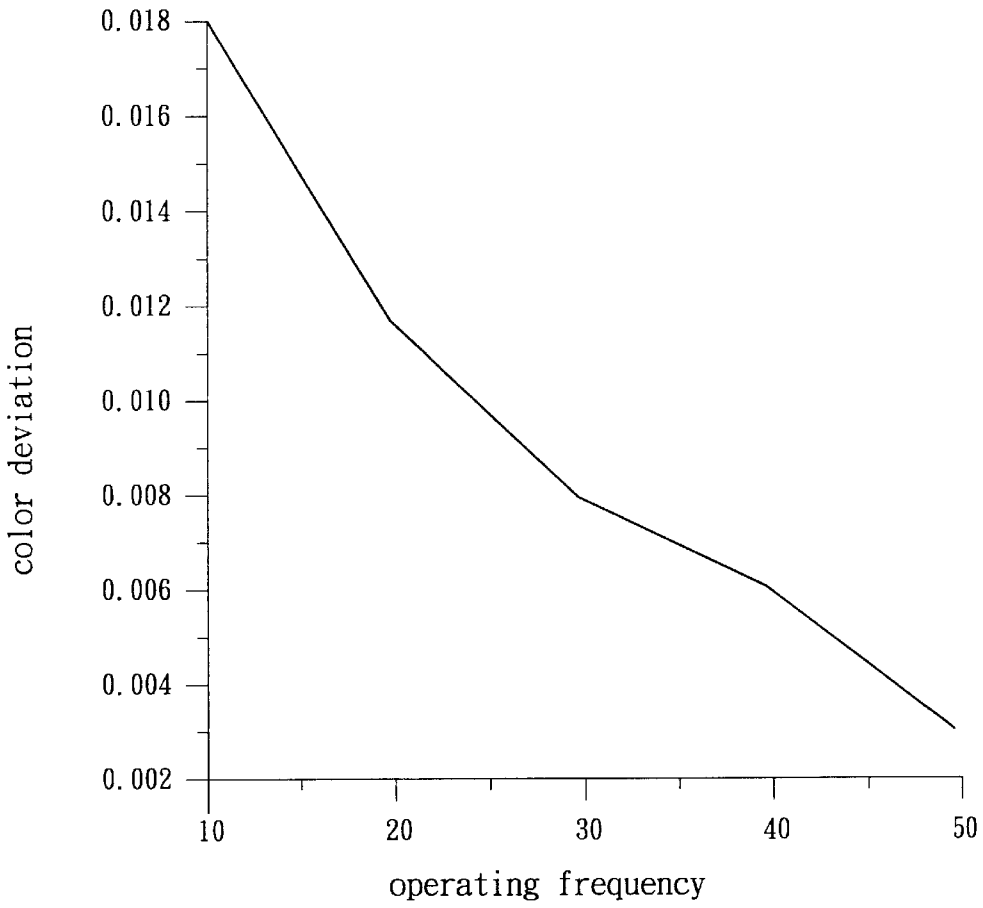
FIG. 4 (Prior Art)
FIG. 4 is a graph showing a relationship of color deviation versus operating frequency obtained by the method according to the invention.

Typically, an image shown on a well known PDP consists of a plurality of pixels. The number of pixels is determined by the resolution of PDP. A pixel consists of three discharge cells capable of emitting red, green, and blue lights respectively. Hence, the color of a pixel of image shown on PDP is a combination of red, green and blue lights emitted by respective discharge cell. For example, a, b, and c are gray scales of red, green and blue lights emitted by respective discharge cell of each pixel of PDP. Also, $R_o$, $G_o$, and $B_o$ are brightness emitted by unit gray scale of phosphor layer in red, green and blue discharge cells of each pixel of PDP. Hence, brightness of red, green, and blue discharge cells may be expressed by equations 1, 2 and 3 below:

$$\text{brightness of red discharge cell}=a\times R_o \quad (1);$$

$$\text{brightness of green discharge cell}=b\times G_o \quad (2);$$

and $$\text{brightness of blue discharge cell}=c\times B_o \quad (3)$$

Also, brightness of pixel may be expressed by the following equation 4:

$$\text{brightness of pixel}=\text{brightness of red discharge cell}+\text{brightness of green discharge cell}+\text{brightness of blue discharge cell}=a\times R_o+b\times G_o+c\times B_o \quad (4)$$

Further, ratio among brightness of red, green and blue discharge cells may be expressed by the following equation 5:

$$\text{brightness of red discharge cell:brightness of green discharge cell:brightness of blue discharge cell}=a\times R_o:b\times G_o:c\times B_o \quad (5)$$

Figure 5:
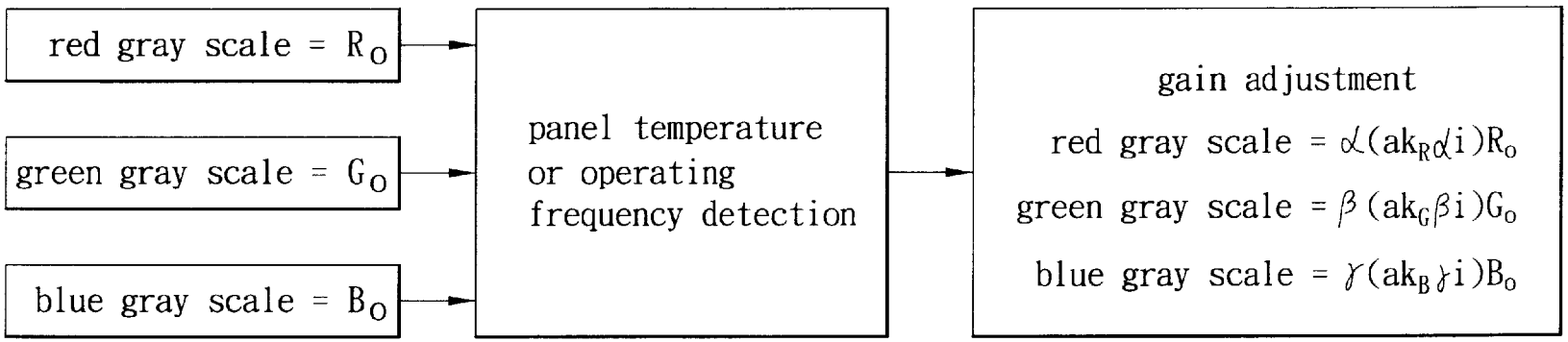
FIG. 5 is a flow chart illustrating the method according to the invention.

One aspect of the invention is to eliminate the adverse effect such as color temperature change and color deviation of PDP caused by such emissivity change. Thus, laws of color matching proposed by Grassman is utilized in which the brightness of color emitted by each of red, green and blue discharge cells may be calculated through a numeric operation as illustrated in the flow chart of FIG. 5. Further, it is possible to adjust the brightness of thus emitted red, green or blue lights by increasing or decreasing the strength of input video signal (or input voltage) of each discharge cell. Hence, the adverse effects such as color temperature change and color deviation of PDP caused by emissivity change as experienced in prior art may be eliminated. As a result, an image having an optimum color purity and color temperature is rendered.

In one embodiment of the invention, reduced brightness per gray scale of each of red, green, and blue discharge cells of PDP due to the panel temperature increase is represented by $T_R$, $T_G$, and $T_B$ respectively. Hence, when panel temperature is increased brightness of each of red, green, and blue discharge cells, and pixel may be expressed in the following equations 6, 7, 8, and 9 respectively:

$$\text{brightness of red discharge cell in elevated temperature environment}=a(R_O-T_R) \quad (6);$$

$$\text{brightness of green discharge cell in elevated temperature environment}=b(G_O-T_G) \quad (7);$$

$$\text{brightness of blue discharge cell in elevated temperature environment}=c(B_O-T_B) \quad (8);$$

and $$\text{brightness of pixel in an elevated temperature environment}=\text{brightness of red discharge cell in an elevated temperature environment}+\text{brightness of green discharge cell in an elevated temperature environment}+\text{brightness of blue discharge cell in an elevated temperature environment}=aR_O+bG_O+cB_O-aT_R-bT_G-cT_B \quad (9)$$

where $aT_R$, $bT_G$, and $cT_B$ are reduced brightness of each of red, green, and blue discharge cells of pixel due to panel temperature increase respectively. Such $aT_R$, $bT_G$, and $cT_B$ are the main factors for causing color temperature change and color deviation of PDP.

As stated above one aspect of the invention is to improve the reduced emissivity per gray scale of each discharge cell due to the panel temperature increase and eliminate the adverse effects such as color temperature change and color deviation of PDP caused by such reduced emissivity. Hence, red, green and blue phosphor layers coated on the corresponding discharge cell are used in an experiment as detailed in FIG. 5. First analyze the reduced emissivity per gray scale on phosphor layer of each discharge cell due to panel temperature increase. Then a temperature function is used to calculate the reduced brightness (i.e., $T_{Ri}$, $T_{Gi}$, and $T_{Bi}$) per gray scale on each of red, green, and blue phosphor layers of discharge cells and obtain expressions to represent their relationship with respect to panel temperature of each discharge cell as below:

$$t_i<T<ti+1\rightarrow T_{Ri}$$

$$t_i<T<ti+1\rightarrow T_{Gi}$$

$$t_i<T<ti+1\rightarrow T_{Bi}$$

where ti and ti+1 are upper and lower temperature limits of respective portion of panel and T is panel temperature or operating frequency. Reliable references, obtained after repeated experiments, are used to establish a comparison table. Hence, a control circuit of PDP may be enabled to select one of $T_{Ri}$, $T_{Gi}$ and $T_{Bi}$ from the comparison table based on measured panel temperature T of the detected element for dynamically calibrating strength of input video signal of respective discharge cell. Then each of red, green and blue lights is emitted from the respective discharge cell. Such lights in turn are used to compensate (i.e., increase) the reduced emissivity per gray scale of each of discharge cells due to panel temperature increase and eliminate the adverse effects such as color temperature change and color deviation of PDP caused by such reduced emissivity. As a result, an image having an optimum color purity and color temperature is rendered. Most importantly, the image quality of a conventional PDP may be greatly improved by implementing the method of the invention.

Moreover, $T_{Ri}$, $T_{Gi}$, and $T_{Bi}$, i.e., reduced brightness per gray scale on respective discharge cell due to panel temperature increase, may be expressed in the following equations 10, 11 and 12:

$$T_{Ri}=k_{Ri}R_o \quad (10);$$

$$T_{Gi}=k_{Gi}G_o \quad (11);$$

and $$T_{Bi}=k_{Bi}B_o \quad (12);$$

where $k_{Ri}$, $k_{Gi}$ and $k_{Bi}$ are brightness compensation coefficients obtained by experiments. $ak_{Ri}$, $bk_{Gi}$, and $ck_{Bi}$ are increased brightness on red, green, and blue discharge cells respectively. Thus, brightness of compensated discharge cells and pixel may be expressed in the following equations 13, 14, 15 and 16 respectively:

$$\text{brightness of red discharge cell after compensation}=a(1+k_{Ri})R_o-aT_{Ri} \quad (13);$$

$$\text{brightness of green discharge cell after compensation}=b(1+k_{Gi})G_o-bT_{Gi} \quad (14);$$

$$\text{brightness of blue discharge cell after compensation}=c(1+k_{Bi})B_o-cT_{Bi} \quad (15);$$

and $$\text{brightness of pixel after compensation}=\text{brightness of red discharge cell after compensation}+\text{brightness of green discharge cell after compensation}+\text{brightness of blue discharge cell after compensation}=a\times R_O+b\times G_O+cx\ B_O \quad (16)$$

In comparison of equations 16 and 4, it is found that the reduced emissivity on phosphor layers of discharge cells due to panel temperature increase may be completely eliminated by the compensated red, green and blue discharge cells. In the case that when phosphor layers are at maximum critical gray scales, discharge number is at a maximum value. Hence, $T_{Ri}$, $T_{Gi}$, and $T_{Bi}$, i.e., reduced brightness per gray scale on respective discharge cell due to the panel temperature increase, can not be further increased by the increased discharge number, thereby an effective compensation on the reduced brightness $T_{Ri}$, $T_{Gi}$, and $T_{Bi}$ is made impossible. In the case that when phosphor layers are at maximum critical gray scales, the reduced brightness per gray scale on respective discharge cells are $k_RR_O$, $k_GG_O$, and $k_BB_O$ where $k_R<1$, $k_G<1$, and $k_B<1$. $k_R$, $k_G$, and $k_B$ are compensation coefficients at maximum critical gray scales of phosphor layers. After experimented, at the maximum critical gray scales of phosphor layers brightness of red, green, and blue discharge cells may be expressed by equations 17, 18 and 19 below:

$$\text{brightness of red discharge cell at maximum critical gray scale}=ak_RR_o \quad (17);$$

$$\text{brightness of green discharge cell at maximum critical gray scale}=bk_GG_o \quad (18);$$

and $$\text{brightness of blue discharge cell at maximum critical gray scale}=ck_BB_o \quad (19)$$

Also, brightness of pixel may be expressed by the following equation 20:

brightness of pixel at maximum critical gray scale=brightness of red discharge cell at maximum critical gray scale+brightness of green discharge cell at maximum critical gray scale+brightness of blue discharge cell at maximum critical gray scale=$ak_R R_O + bk_G G_O + ck_B B_O$ (20)

Further, ratio among brightness of red, green and blue discharge cells may be expressed by the following equation 21:

brightness of red discharge cell:brightness of green discharge cell:brightness of blue discharge cell=$ak_R R_o : bk_G G_o : ck_B B_o$ (21)

In comparison of equations 21 and 5, it is found that above ratio in equation 21 has changed when panel temperature rises. Such change is the main factor that causes color deviation of PDP and lowers image quality thereof. Hence, in another preferred embodiment of the invention a technique is proposed to solve above problem, that is, reduced brightness per gray scale on respective discharge cell due to the panel temperature increase $T_{Ri}$, $T_{Gi}$, and $T_{Bi}$, can not be compensated at maximum critical gray scales. In detail, at maximum critical gray scale of PDP, a control circuit of PDP is enabled to select correct gains a $\alpha_i$, $\beta_i$, and $\gamma_i$ from the comparison table based on measured panel temperature T of the detected element for dynamically calibrating strength of input video signal of respective discharge cell. As a result, the reduced emissivity per gray scale of each of discharge cells due to panel temperature rise is increased. Above gains $\alpha_i$, $\beta_i$, and $\gamma_i$ may be expressed in the following equations 22 and 23:

$$\alpha_i : \beta_i : \gamma_i = k_G k_B : k_R k_B : k_R k_G \quad (22)$$

$$\max\{\alpha_i, \beta_i, \gamma_i) \leq 1 \quad (23)$$

Further, brightness of compensated discharge cells and pixel may be expressed in the following equations 24, 25, 26 and 27 respectively:

brightness of red discharge cell after compensation=$(a\ k_R \alpha_i) R_o$ (24);

brightness of green discharge cell after compensation=$(b\ k_G \beta_i) G_o$ (25);

brightness of blue discharge cell after compensation=$(ck_B \gamma_i) B_o$ (26);

and brightness of pixel after compensation=brightness of red discharge cell after compensation+brightness of green discharge cell after compensation+brightness of blue discharge cell after compensation=$(ak_R \alpha_i) R_0 + (bk_{G0} \beta_i) G_O + (ck_B \gamma_i) B_o$ (27)

In comparison of equations 24 and 26, it is found that ratio among brightness of red, green and blue discharge cells may be expressed by the following equation 28:

brightness of red discharge cell after compensation:brightness of green discharge cell after compensation:brightness of blue discharge cell after compensation=$(ak_R \alpha_i) R_0 : (bk_G \beta_i) G_0 : (ck_B \gamma_i) B_0 = aR_0 : bG_0 : cB_0$ (28)

In comparison of equations 28 and 5, it is found that above ratio among brightness of red, green and blue discharge cells has returned to a true ratio, resulting in a total elimination of color deviation caused when phosphor layers are in the maximum critical gray scales.

As understood that a linear relationship exists between panel temperature of PDP and operating frequency. Hence, the invention employs a control circuit of PDP based on measured operating frequency of the detected element for dynamically calibrating strength of input video signal of respective discharge cell. Then red, green and blue lights are emitted which in turn are used to compensate (i.e., increase) the reduced brightness due to the change of operating frequency. As a result, an image having an optimum color purity and color temperature is rendered even when PDP is operated in various operating frequencies.

While the invention has been described by means of specific embodiments, numerous modifications and variations could be made thereto by those skilled in the art without departing from the scope and spirit of the invention set forth in the claims.

What is claimed is:

1. In a plasma display panel (PDP) a dynamic calibration method comprising the steps of:

(a) utilizing laws of color matching for calculating an emissivity change of a pixel of said PDP in response to a brightness change of one of red, green, and blue lights emitted by a corresponding one of red, green and blue discharge cells of said PDP through a numeric operation;

(b) dynamically adjusting brightness of one of said emitted red, green, and blue lights by increasing or decreasing strength of input video signal of each of said discharge cells; and (c) eliminating a color temperature and a color deviation of said PDP due to an emissivity change.

2. The method of claim 1, wherein in said step (a) after said brightness change of one of red, green, and blue lights, a reduced brightness per gray scale of each of said discharge cells of PDP is obtained by combining said red, green, and blue lights in a predetermined ratio based on a color combination principle through said numeric operation.

3. The method of claim 2, wherein values generated in said numeric operation are gains of said discharge cells, whereby said PDP is operative to dynamically adjust strength of said input video signal of each of said discharge cells and utilize said emitted lights to compensate said reduced brightness of each of said discharge cells due to said emissivity change.

4. The method of claim 3, wherein said gains are utilized in an experiment on red, green and blue phosphor layers each coated on said corresponding discharge cell for analyzing said reduced emissivity per gray scale on said phosphor layer of each discharge cell due to said PDP temperature increase, calculating a gain of each of said red, green, and blue lights by said corresponding discharge cell, and expressing said gain of each of said red, green, and blue lights in terms of said PDP temperature, thereby establishing a first comparison table with respect to said gains involved in said experiment.

5. The method of claim 4, wherein said PDP comprises a control circuit operable to dynamically calibrate strength of said input video signal of each of said discharge cells based on said measured PDP temperature of a detected element by referencing said gains in said first comparison table, whereby compensate said reduced brightness emissivity per gray scale of each discharge cell due to said PDP temperature increase.

6. The method of claim 3, wherein said gains are utilized in an experiment on red, green and blue phosphor layers each coated on said corresponding discharge cell for analyzing said reduced emissivity per gray scale on said phosphor layer of each discharge cell due to an operating frequency increase calculating a gain of each of said red, green, and blue lights by said corresponding discharge cell, and expressing said gain of each of said red, green, and blue lights in terms of said operating frequency, thereby establishing a second comparison table with respect to said gains involved in said experiment.

7. The method of claim 6, wherein said PDP comprises a control circuit operable to dynamically calibrate strength of said input video signal of each of said discharge cells based on said measured operating frequency of a detected element by referencing said gains in said comparison table, whereby compensate said reduced brightness emissivity per gray scale of each discharge cell due to said operating frequency increase.

8. The method of claim 1, wherein said input video signal of each of said discharge cells is an input voltage of each of said discharge cells.

* * * * *